US010513316B2

(12) United States Patent
Park

(10) Patent No.: US 10,513,316 B2
(45) Date of Patent: Dec. 24, 2019

(54) INSULATION STRUCTURE, FOR LIQUEFIED GAS CARGO HOLD, HAVING ANCHOR STRIP REMOVED, CARGO HOLD COMPRISING INSULATION STRUCTURE, AND LIQUEFIED GAS CARRIER COMPRISING CARGO HOLD

(71) Applicant: DAEWOO SHIPBUILDING & MARINE ENGINEERING CO., LTD., Seoul (KR)

(72) Inventor: Kwang Jun Park, Seoul (KR)

(73) Assignee: DAEWOO SHIPBUILDING & MARINE ENGINEERING CO., LTD., Seoul (KR)

( * ) Notice: Subject to any disclaimer, the term of this patent is extended or adjusted under 35 U.S.C. 154(b) by 0 days.

(21) Appl. No.: 15/754,229

(22) PCT Filed: Apr. 12, 2016

(86) PCT No.: PCT/KR2016/003813
§ 371 (c)(1),
(2) Date: Feb. 21, 2018

(87) PCT Pub. No.: WO2017/034117
PCT Pub. Date: Mar. 2, 2017

(65) Prior Publication Data

US 2018/0244355 A1 Aug. 30, 2018

(30) Foreign Application Priority Data

Aug. 21, 2015 (KR) ..... 10-2015-0117940

(51) Int. Cl.
*B63B 25/16* (2006.01)
*F17C 3/02* (2006.01)
*B63B 25/08* (2006.01)

(52) U.S. Cl.
CPC ..... *B63B 25/16* (2013.01); *F17C 3/027* (2013.01); *B63B 2025/087* (2013.01);
(Continued)

(58) Field of Classification Search
CPC ..... B63B 17/00; B63B 25/00; B63B 25/08; B63B 25/16; F17C 3/00; F17C 3/02; F17C 3/027; F17C 3/04; B65D 90/06
(Continued)

(56) References Cited

U.S. PATENT DOCUMENTS

2013/0098931 A1* 4/2013 Bang ..... F17C 3/027 220/694

FOREIGN PATENT DOCUMENTS

JP 40-14279 Y 5/1965
JP 52-131607 U 10/1977
(Continued)

OTHER PUBLICATIONS

International Search Report dated Jul. 8, 2016 in PCT/KR2016/003813 which is the parent application and its English translation—4 pages.
(Continued)

*Primary Examiner* — Lars A Olson
(74) *Attorney, Agent, or Firm* — Knobbe, Martens, Olson & Bear LLP

(57) ABSTRACT

The present invention relates to an insulation structure, for a liquefied gas cargo hold, having an anchor strip removed, a cargo hold comprising the insulation structure, and a liquefied gas carrier comprising the cargo hold. A thermal protection member is substituted for an existing anchor strip, thereby effectively preventing damage on an upper insulating panel, due to a hot gas and heat transfer during welding of a membrane, by means of the thermal protection member as well as enhancing the fixing force of the membrane. The
(Continued)

weight of a cargo hold can be reduced by means of forming the thermal protection member from a material in which aluminum foil is covered with glass cloth. And by means of removing an existing SUS anchor strip, rivet processing is not required and thus constructability can be enhanced.

11 Claims, 5 Drawing Sheets

(52) U.S. Cl.
CPC ..... *F17C 2203/0333* (2013.01); *F17C 2203/0646* (2013.01); *F17C 2221/033* (2013.01); *F17C 2270/0105* (2013.01)

(58) Field of Classification Search
USPC ..... 114/74 A
See application file for complete search history.

(56) References Cited

FOREIGN PATENT DOCUMENTS

| | | | |
|---|---|---|---|
| JP | 5-85463 | A | 4/1993 |
| JP | 2011-519004 | A | 6/2011 |
| JP | 2013-530875 | A | 8/2013 |
| KR | 10-2013-0112559 | A | 10/2013 |
| KR | 10-2013-0125548 | A | 11/2013 |
| KR | 10-2014-0044133 | A | 4/2014 |
| KR | 10-1393005 | B1 | 5/2014 |

OTHER PUBLICATIONS

Office Action of corresponding Japanese Patent Application No. 2018-509568—3 pages (dated Mar. 26, 2019).

* cited by examiner

【FIG. 1】
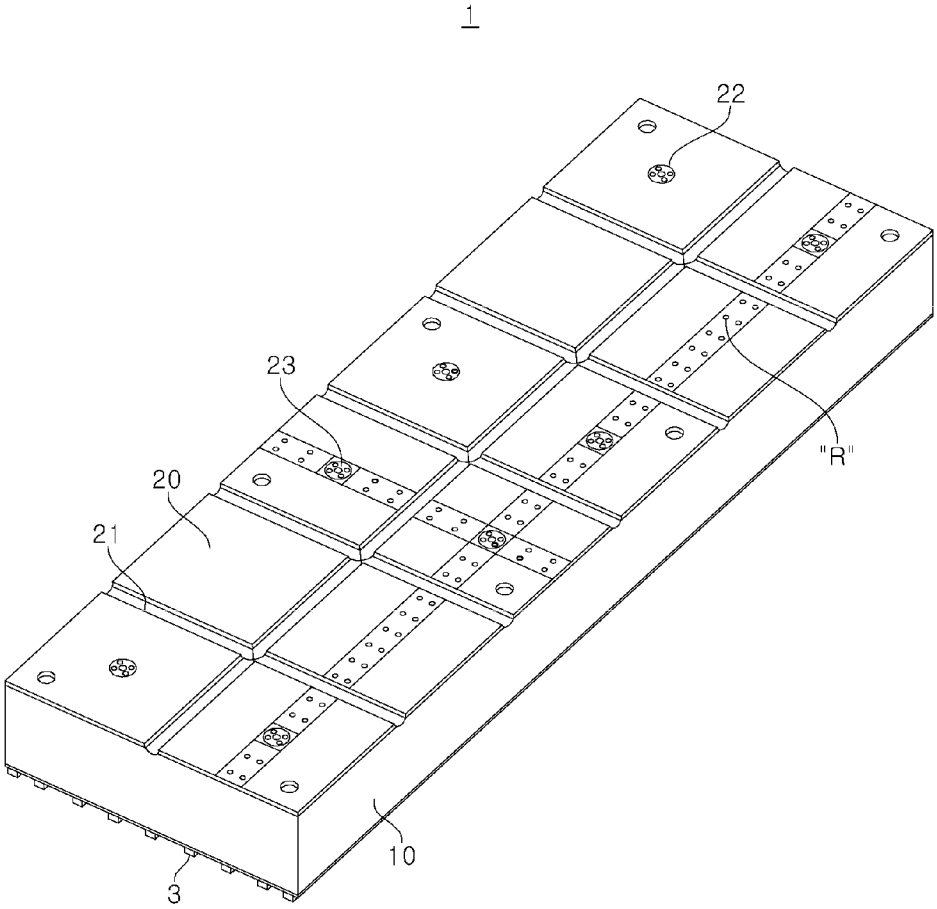

【FIG. 2】
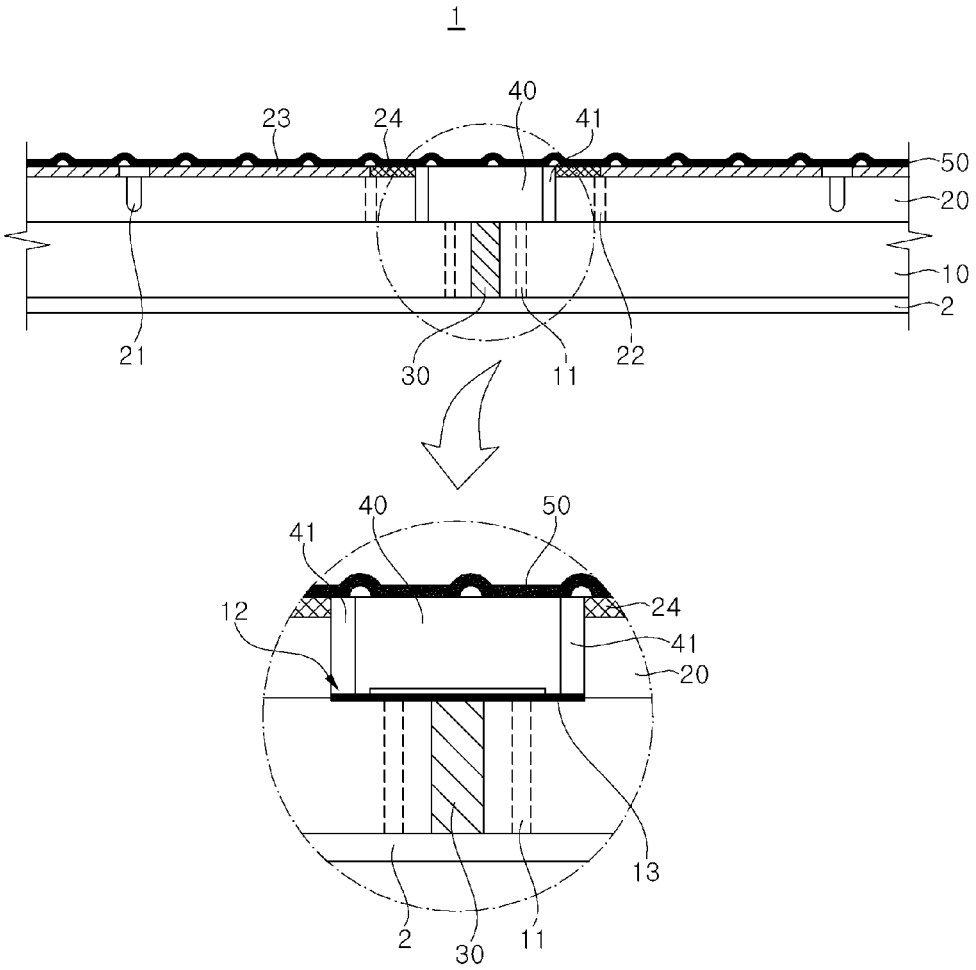

【FIG. 3】
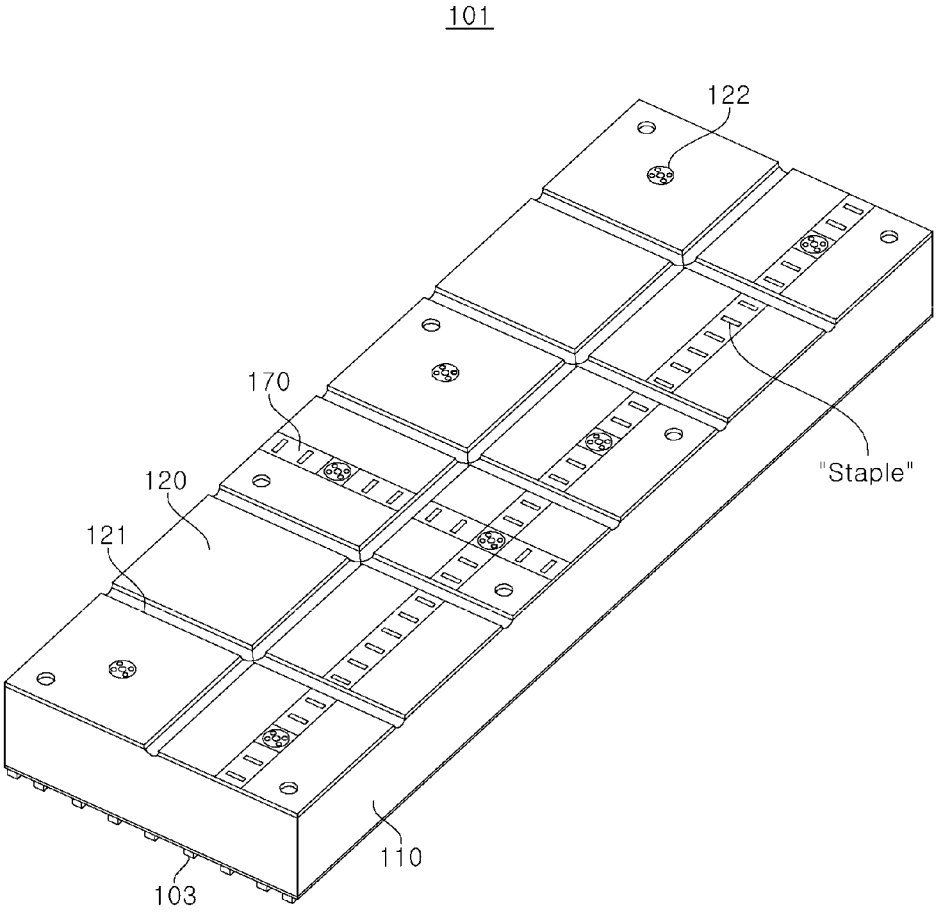

【FIG. 4】
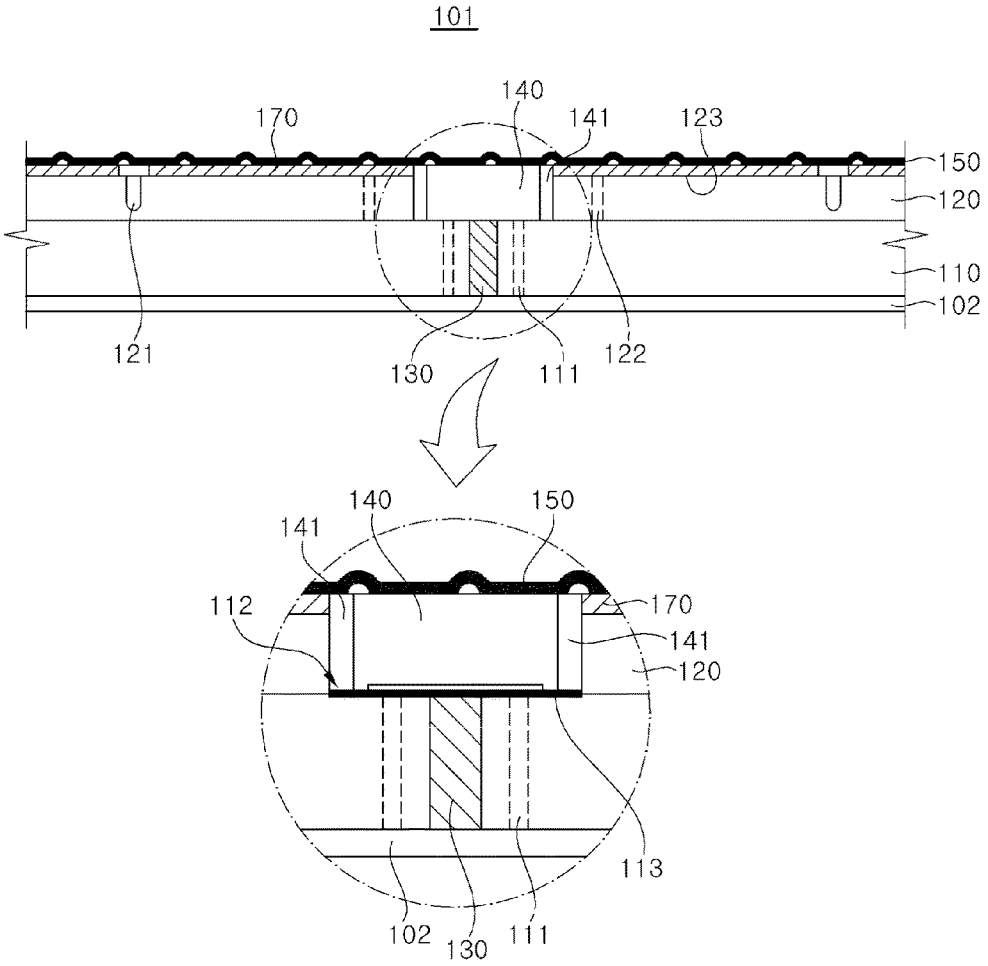

【FIG. 5】
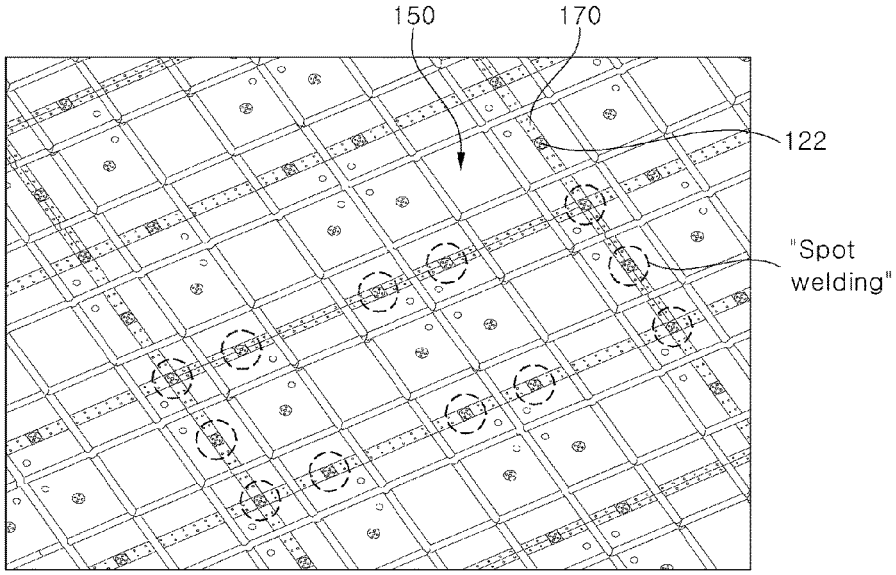
【FIG. 6】
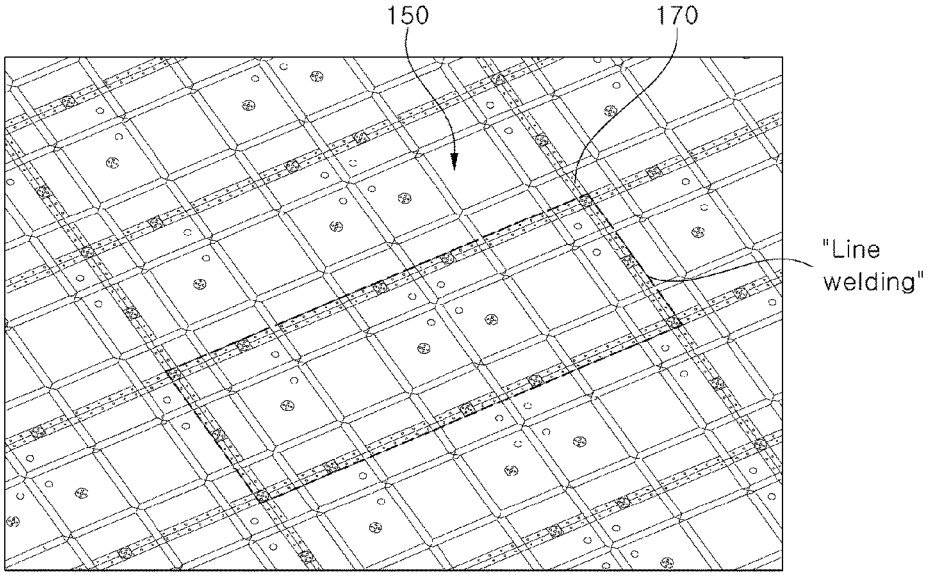

INSULATION STRUCTURE, FOR LIQUEFIED GAS CARGO HOLD, HAVING ANCHOR STRIP REMOVED, CARGO HOLD COMPRISING INSULATION STRUCTURE, AND LIQUEFIED GAS CARRIER COMPRISING CARGO HOLD

TECHNICAL FIELD

The present invention relates to an anchor strip-free insulation structure for liquefied gas cargo holds, a cargo hold including the insulation structure, and a liquefied gas carrier including the cargo hold, and, more particularly, to an anchor strip-free insulation structure for liquefied gas cargo holds, which includes a thermal protection member in place of a typical anchor strip to effectively prevent an upper insulation panel from being damaged by flame generated during welding of a membrane sheet and to firmly secure the membrane sheet, wherein the thermal protection member is formed of aluminum foil covered with glass cloth to reduce the weight of the cargo hold, a cargo hold including the insulation structure, and a liquefied gas carrier including the cargo hold.

BACKGROUND ART

Generally, natural gas is transported in a gaseous state via onshore or offshore gas pipelines, or is transported to a distant destination by an LNG carrier after being liquefied into LNG.

LNG is obtained by cooling natural gas to cryogenic temperatures, for example, about −163° C. and has a volume of about 1/600 that of natural gas in a gaseous state. Thus, LNG is suited to long distance transport by sea.

An LNG carrier, which is designed to carry LNG by sea to an onshore source of demand, or an LNG regasification vessel (LNG RV), which is designed to carry LNG by sea to an onshore source of demand, regasify the LNG, and discharge the regasified LNG to the onshore source of demand, is provided with a storage tank capable of withstanding cryogenic temperatures of LNG (commonly referred to as "cargo hold").

Recently, there is increasing demand for floating offshore structures such as LNG-floating production, storage and offloadings (FPSOs) and LNG-floating storage and regasification units (FSRUs). Such a floating offshore structure is also provided with a storage tank that is used in LNG carriers or LNG RVs.

An LNG-FPSO is a floating offshore structure that is designed to liquefy produced natural gas, store the liquefied natural gas in a storage tank, and, if necessary, offload the LNG onto an LNG carrier.

An LNG-FSRU is a floating offshore structure that is designed to store LNG offloaded from an LNG carrier in a storage tank and, if necessary, regasify the LNG and supply the regasified LNG to an onshore source of demand.

Such an offshore vessel carrying LNG by sea or storing LNG, such as LNG carriers, LNG RVs, LNG FPSOs, and LNG FSRUs, is provided therein with a storage tank storing LNG in a cryogenic state.

Such a storage tank is divided into an independent storage tank and a membrane-type storage tank depending on whether an insulator thereof directly receives a load of a cargo.

In addition, the membrane-type storage tank is divided into a GTT NO 96-type tank and a TGZ Mark III-type, and the independent storage tank is divided into an MOSS-type tank and an IHI-SPB-type tank.

Here, the insulation material and structure of the membrane-type storage tank may vary depending upon the type of a special metal sheet that is used as a material for the storage tank. Specifically, the GTT NO 96-type tank is manufactured using an Invar sheet (an alloy mainly composed of iron and nickel and having a very low coefficient of thermal expansion) and the Mark III-type tank is manufactured using a stainless steel sheet.

The GTT NO 96-type storage tank has a structure in which a primary and secondary sealing wall formed of an Invar sheet having a thickness of 0.5 mm to 1.5 mm and a primary and secondary insulation wall formed of a plywood box and perlite are alternately stacked on an inner wall of a hull.

In the GTT NO 96-type storage tank, the secondary sealing wall has almost the same level of liquid tightness and strength as the primary sealing wall, thereby safely supporting a cargo for a considerable period of time even when the primary sealing wall leaks.

An insulation system of the GTT NO 96-type storage tank is composed of two layers of insulation boxes formed of Invar (36% nickel), pearlite, and plywood.

Now, a typical cargo hold insulation structure for LNG carriers will be described with reference to the drawings.

FIG. 1 is a perspective view of a typical cargo hold insulation structure for LNG carriers.

Referring to FIG. 1, the typical cargo hold insulation structure for LNG carriers includes a plurality of insulation panel assembly units 1 disposed in series, wherein each of the insulation assembly units includes a lower insulation panel 10, an upper insulation panel 20, a flat joint 30, a top bridge panel 40, and a membrane sheet 50.

The lower insulation panel 10 is secured to an inner wall of a storage tank 2 (or inner hull) using epoxy mastic 3 and a stud bolt 11.

The flat joint 30 is disposed in a space between the lower insulation panels 10 of the respective insulation panel assembly units 1 facing each other to seal the space and provide secondary insulation.

The lower insulation panel 10 may be formed of reinforced-polyurethane foam and is provided on an upper surface thereof with a rigid triplex 12 (or rigid secondary barrier (RSB). In other words, the lower insulation panel is provided with plywood on a surface thereof facing the inner wall 2 of the tank and is provided with the rigid triplex 12 on the other surface (i.e., upper surface) thereof.

The upper insulation panel 20 includes a sawing line 21, a securing base support 22 (or metallic insert), an anchor strip 23, and a thermal protection 24 and is attached to the upper side of the lower insulation panel 10.

The top bridge panel 40 is disposed in a space between the upper insulation panels 20 of the respective insulation panel assembly units 1 facing each other to seal the space and provide primary insulation.

The upper insulation panel 20 may be formed of reinforced polyurethane foam and may be provided on an upper surface thereof with plywood.

The sawing line 21 is formed in the upper insulation panel 20 to prevent deformation of a hull due to contraction and expansion at cryogenic temperatures and may include a plurality of transverse and longitudinal sawing lines crossing at right angles to form a grid pattern.

The thermal protection 24 is disposed at at least one end of the anchor strip 23 to compensate for reduction in resistance of the lower and upper insulation panels 10, 20 to damage by deformation of the hull and thermal deformation of the membrane sheet 50.

A gap 41 is formed between the upper insulation panel 20 and the top bridge panel 40.

The securing base support 22 includes a plurality of securing base supports formed in the upper insulation panel 20.

The anchor strip 23 is formed of stainless steel and is secured to the upper insulation panel 20 using a rivet R.

The thermal protection 24 serves to prevent the membrane sheet 50 from being directly welded to the upper insulation panel 20 while preventing the upper insulation panel 20 from being damaged by flame or heat generated during welding of the membrane sheet 50.

The flat joint 30 is disposed in a space between the lower insulation panels 10 of the respective insulation panel assembly units 1 facing each other to provide secondary insulation. The flat joint 30 may be formed of glass wool.

The top bridge panel 40 is attached to upper sides of the flat joint 30 and the lower insulation panel 10 without the attached upper insulation panel 20 to seal a space between the upper insulation panels 20 of the respective insulation panel assembly units 1 facing each other and to provide primary insulation.

The top bridge panel 40 may be formed of reinforced polyurethane foam and may be attached to an upper side of a flexible triplex 13 disposed on the lower insulation panel 10 and the flat joint 30.

The top bridge panel 40 is disposed such that a gap 41 is formed between the top bridge panel and each of the upper insulation panels 20 of the respective insulation panel assembly units 1 facing each other, thereby preventing the lower and upper insulation panels 10, 20 from being damaged by deformation of the hull and thermal deformation of the membrane sheet 50, along with the sawing line 21.

The membrane sheet 50 is securely coupled to the upper sides of the upper insulation panel 20 and the top bridge panel 40 through the anchor strip 23.

The membrane sheet 50 is a corrugated membrane sheet and may be embossed to have uneven upper and lower surfaces.

Since an LNG carrier is intended to carry LNG at cryogenic temperatures, for example, about −163° C., by sea, various advanced technologies are required to provide heat insulation performance, structural performance, hermeticity and the like to a cargo hold of the LNG carrier. Particularly, for a membrane-type cargo hold for LNG carriers, a membrane sheet is welded to an upper side of an upper insulation panel to prevent leakage of LNG.

In a typical cargo hold insulation structure for LNG carriers, in order to provide hermeticity to the cargo hold, individual membrane sheets 50 are secured to an anchor strip 23 of an upper insulation panel 12 by spot welding, followed by line welding of adjacent overlapping membrane sheets 50.

Thus, such a typical anchor strip serves to allow the membrane sheet to be spot-welded thereto while preventing damage to the upper insulation panel due to flame or heat generated during welding.

However, the typical anchor strip is formed of SUS and thus requires additional components such as a securing rivet and additional processes such as machining of rivet mounting holes in both the anchor strip and the upper insulation panel and riveting, causing increase in production cost and product price.

DISCLOSURE

Technical Problem

Embodiments of the present invention have been conceived to solve such a problem in the art and provide an anchor strip-free insulation structure for liquefied gas cargo holds, which includes a thermal protection member in place of a typical anchor strip to effectively prevent an upper insulation panel from being damaged by flame or heat generated during welding of a membrane sheet and to firmly secure the membrane sheet, wherein the thermal protection member is formed of aluminum foil covered with glass cloth to reduce the weight of the cargo hold and eliminate a need for a riveting process for securing a typical SUS anchor strip, thereby improving constructability while reducing production costs, a cargo hold including the insulation structure, and a liquefied gas carrier including the cargo hold.

Technical Solution

In accordance with aspects of the present invention, there are provided an anchor strip-free insulation structure for liquefied gas cargo holds, a cargo hold including the insulation structure, and a liquefied gas carrier including the cargo hold.

The anchor strip-free insulation structure for the liquefied gas cargo hold includes a plurality of insulation panel assembly units disposed in series, each of the insulation panel assembly units including a lower insulation panel, an upper insulation panel stacked on the lower insulation panel, and a membrane sheet welded to the upper insulation panel, wherein the upper insulation panel includes a thermal protection member disposed in a groove thereof to prevent the upper insulation panel from being damaged by flame or heat generated during welding of the membrane sheet and to firmly secure the membrane sheet.

The lower insulation panel may be secured to an inner wall of the cargo hold (or inner hull) using epoxy mastic and a stud bolt, and a flat joint may be disposed in a space between the lower insulation panels of the respective insulation panel assembly units facing each other to seal the space and provide secondary insulation.

In addition, the lower insulation panel may be provided on an upper surface thereof with a rigid triplex (or rigid secondary barrier (RSB)).

The upper insulation panel may include a sawing line, a securing base support (or metallic insert), and the thermal protection member and may be disposed on an upper side of the lower insulation panel.

A top bridge panel may be disposed in a space between the upper insulation panels of the respective insulation panel assembly units facing each other to seal the space and provide primary insulation.

The thermal protection member may be disposed in the groove of the upper insulation panel to prevent the upper insulation panel from being damaged by flame or heat generated during welding of the membrane sheet, and the securing base support may be disposed in the upper insulation panel to pass through the thermal protection member.

Spot welding for securing the membrane sheet may be performed at the securing base support, and line welding for connection between the membrane sheets may be performed on the thermal protection member.

The thermal protection member may be securely seated in the groove of the upper insulation panel using a staple and a securing pin.

In addition, the thermal protection member may be formed of an aluminum foil covered with glass cloth.

The flat joint 130 may be formed of glass wool.

The top bridge panel may be formed of reinforced polyurethane foam and may be attached to an upper side of a flexible triplex disposed on the lower insulation panel and the flat joint.

The top bridge panel may be disposed such that a gap is formed between the top bridge panel and each of the upper insulation panels of the respective insulation panel assembly units to prevent the lower and upper insulation panels from being damaged by deformation of the hull and thermal deformation of the membrane sheet, along with the sawing line.

The membrane sheet may be a corrugated membrane sheet and may be embossed to have uneven upper and lower surfaces.

Advantageous Effects

Embodiments of the present invention provide an anchor strip-free insulation structure for liquefied gas cargo holds which uses a thermal protection member in place of a typical anchor strip to effectively prevent an upper insulation panel from being damaged by flame or heat generated during welding of a membrane sheet and to firmly secure the membrane sheet, wherein the thermal protection member is formed of aluminum foil covered with glass cloth to reduce the weight of the cargo hold and eliminate a need for a riveting process for securing a typical SUS anchor strip, thereby improving constructability while reducing production costs.

DESCRIPTION OF DRAWINGS

FIG. 1 is a perspective view of a typical cargo hold insulation structure for LNG carriers.

FIG. 2 is a sectional view of the typical cargo hold insulation structure for LNG carriers.

FIG. 3 is a perspective view of an anchor strip-free insulation structure of a liquefied gas cargo hold according to the present invention.

FIG. 4 is a sectional view of the anchor strip-free insulation structure of the liquefied gas cargo hold according to the present invention.

FIG. 5 is a perspective view showing a state in which spot welding for securing a membrane sheet is performed at a securing base support.

FIG. 6 is a perspective view showing a state in which line welding for connection between membranes is performed on a thermal protection member.

BEST MODE

In accordance with aspects of the present invention, there are provided an anchor strip-free insulation structure for liquefied gas cargo holds, a cargo hold including the insulation structure, and a liquefied gas carrier including the cargo hold.

An anchor strip-free insulation structure for liquefied gas cargo holds according to the present invention includes a plurality of insulation panel assembly units disposed in series, each of the insulation panel assembly units including a lower insulation panel, an upper insulation panel stacked on the lower insulation panel, and a membrane sheet welded to the upper insulation panel, wherein the upper insulation panel includes a thermal protection member disposed in a groove thereof to prevent the upper insulation panel from being damaged by flame or heat generated during welding of the membrane sheet and to firmly secure the membrane sheet.

The lower insulation panel is secured to an inner wall of the cargo hold (or inner hull) using epoxy mastic and a stud bolt, and a flat joint is disposed in a space between the lower insulation panels of the respective insulation panel assembly units facing each other to seal the space and provide secondary insulation.

In addition, the lower insulation panel is provided on an upper surface thereof with a rigid triplex (or rigid secondary barrier (RSB)).

The upper insulation panel includes a sawing line, a securing base support (or metallic insert), and the thermal protection member and is disposed on an upper side of the lower insulation panel.

A top bridge panel is disposed in a space between the upper insulation panels of the respective insulation panel assembly units facing each other to seal the space and provide primary insulation.

The thermal protection member is disposed in the groove of the upper insulation panel to prevent the upper insulation panel from being damaged by flame or heat generated during welding of the membrane sheet, and the securing base support is disposed in the upper insulation panel to pass through the thermal protection member.

Spot welding for securing the membrane sheet is performed at the securing base support, and line welding for connection between the membrane sheets is performed on the thermal protection member.

The thermal protection member may be securely seated in the groove of the upper insulation panel using a staple and a securing pin.

In addition, the thermal protection member may be formed of aluminum foil covered with glass cloth.

The flat joint 130 may be formed of glass wool.

The top bridge panel may be formed of reinforced polyurethane foam and may be attached to an upper side of a flexible triplex disposed on the lower insulation panel and the flat joint.

The top bridge panel is disposed such that a gap is formed between the top bridge panel and each of the upper insulation panels of the respective insulation panel assembly units to prevent the lower and upper insulation panels from being damaged by deformation of the hull and thermal deformation of the membrane sheet, along with the sawing line.

The membrane sheet is a corrugated membrane sheet and may be embossed to have uneven upper and lower surfaces.

MODE FOR INVENTION

Hereinafter, an anchor strip-free insulation structure for liquefied gas cargo holds according to the present invention, a cargo hold including the insulation structure, and a liquefied gas carrier including the cargo hold will be described in detail with reference to the accompanying drawings.

FIG. 3 is a perspective view of an anchor strip-free insulation structure of a liquefied gas cargo hold according to the present invention, FIG. 4 is a sectional view of the anchor strip-free insulation structure of the liquefied gas cargo hold according to the present invention, FIG. 5 is a perspective view showing a state in which spot welding for securing a membrane sheet is performed at a securing base support, and FIG. 6 is a perspective view showing a state in which line welding for connection between membrane sheets is performed on a thermal protection member.

Referring to FIGS. 3 to 4, an anchor strip-free insulation structure for liquefied gas cargo holds according to the present invention includes a plurality of insulation panel assembly units disposed in series, wherein each of the insulation panel assembly units includes a lower insulation panel 110, an upper insulation panel 120, a flat joint 130, a top bridge panel 140, and a membrane sheet 150.

The upper insulation panel 120 includes a thermal protection member 170 in place of a typical anchor strip 23 to secure the membrane sheet 150.

The lower insulation panel 110 is secured to an inner wall 102 of the cargo hold (or inner hull) using epoxy mastic 103 and a stud bolt 111, and the flat joint 130 is disposed in a space between the lower insulation panels 110 of the respective insulation panel assembly units 101 facing each other to seal the space and provide secondary insulation.

In addition, the lower insulation panel 110 is provided on an upper surface thereof with a rigid triplex 112 (or rigid secondary barrier (RSB)).

The upper insulation panel 120 includes a sawing line 121, a securing base support 122 (or metallic insert), and the thermal protection member 170 and is disposed on an upper side of the lower insulation panel 110.

The top bridge panel 140 is disposed in a space between the upper insulation panels 120 of the respective insulation panel assembly units 101 facing each other to seal the space and provide primary insulation.

The thermal protection member 170 is disposed in a groove 123 of the upper insulation panel 120 to prevent the upper insulation panel 120 from being damaged by flame or heat generated during welding of the membrane sheet 150, and the securing base support 122 is disposed in the upper insulation panel 120 to pass through the thermal protection member 170.

Referring to FIG. 5, spot welding for securing the membrane sheet 150 is performed at the securing base support 122.

Referring to FIG. 6, line welding for connection between the membrane sheets 150 is performed on the thermal protection member 170.

The thermal protection member 170 may be securely seated in the groove 123 of the upper insulation panel 120 using a staple and a securing pin.

The thermal protection member 170 may be formed of aluminum foil covered with glass cloth.

The flat joint 130 may be formed of glass wool.

The top bridge panel 140 may be formed of reinforced polyurethane foam and may be attached to an upper side of a flexible triplex 130 disposed on the lower insulation panel 110 and the flat joint 130.

In addition, the top bridge panel 140 is disposed such that a gap is formed between the top bridge panel and each of the upper insulation panels 120 of the respective insulation panel assembly units 101 facing each other to prevent the lower and upper insulation panels 110, 120 from being damaged by deformation of the hull and thermal deformation of the membrane sheet 150, along with the sawing line 121.

The membrane sheet 50 is a corrugated membrane sheet and may be embossed to have uneven upper and lower surfaces.

The anchor strip-free insulation structure according to the present invention uses the thermal protection member in place of a typical anchor strip to effectively prevent the upper insulation panel 110 from being damaged by flame or heat generated during welding of the membrane sheet and to firmly secure the membrane sheet 50, wherein the thermal protection member 170 may be formed of aluminum foil covered with glass cloth to reduce the weight of a cargo hold and eliminate a need for a riveting process for securing a typical SUS anchor strip, thereby improving constructability.

Although some embodiments have been described herein, it should be understood by those skilled in the art that these embodiments are given by way of illustration only and the present invention is not limited thereto. In addition, it should be understood that various modifications, variations, and alterations can be made by those skilled in the art without departing from the spirit and scope of the present invention. Therefore, the scope of the invention should be limited only by the accompanying claims and equivalents thereof.

INDUSTRIAL APPLICABILITY

As described above, the anchor strip-free insulation structure for cargo holds according to the present invention uses the thermal protection member in place of a typical anchor strip to effectively prevent the upper insulation panel from being damaged by flame or heat generated during welding of the membrane sheet and to firmly secure the membrane sheet, wherein the thermal protection member may be formed of aluminum foil covered with glass cloth to reduce the weight of the cargo hold and eliminate a need for a riveting process for securing a typical SUS anchor strip, thereby improving constructability while reducing production costs.

The invention claimed is:

1. An anchor strip-free insulation structure for a liquefied gas cargo hold, comprising:

a lower insulation;

an upper insulation placed over the lower insulation, wherein the upper insulation comprises an upper insulation surface facing away from the lower insulation and a groove formed into the upper insulation surface;

a membrane placed over the upper insulation and comprising a bottom surface facing the upper insulation;

a thermal protection member disposed in the groove of the upper insulation surface and between the upper insulation surface and the membrane placed over the upper insulation; and a securing base support spot-welded to the bottom surface of the membrane and inserted into the upper insulation, wherein the membrane comprises a plurality of membrane sheets that are laterally arranged and line-welded together to provide the membrane, wherein the thermal protection member interposed between the membrane and the upper insulation is configured to protect the upper insulation from damage by flame or heat from line-welding of the plurality of membrane sheets.

2. The anchor strip-free insulation structure according to claim 1, wherein the upper insulation comprises a plurality of upper insulation panels, wherein the lower insulation comprises a plurality of lower insulation panels.

3. The anchor strip-free insulation structure according to claim 1, wherein the thermal protection member is formed of aluminum foil covered with glass cloth.

4. The anchor strip-free insulation structure according to claim 1, wherein the lower insulation comprises first and second lower insulation panels and a flat joint formed of glass wool and disposed between the first and second lower insulation panels.

5. The anchor strip-free insulation structure according to claim 4, wherein the upper insulation comprises first and second upper insulation panels and a top bridge panel is-formed of reinforced polyurethane foam and placed over the flat joint, the top bridge panel being disposed between the first and second upper insulation panels.

6. The anchor strip-free insulation structure according to claim 1, wherein the membrane comprises corrugated portions.

7. An anchor strip-free insulation structure for a cargo hold, comprising:

a lower insulation secured to an inner hull of a ship, the lower insulation comprising first and second lower insulation panels and a flat joint disposed between the first and second lower insulation panels for sealing a gap between the first and second lower insulation panels;

an upper insulation placed over the lower insulation, the upper insulation comprising first and second upper insulation panels and a top bridge panel placed over the flat joint and disposed between the first and second upper insulation panels for sealing a gap between the first and second upper insulation panels;

a membrane placed over the upper insulation, and comprising a first membrane sheet and a second membrane sheet;

the upper insulation comprising a groove formed on a surface facing away from the lower insulation;

a thermal protection member disposed in the groove; and a securing base support inserted into the upper insulation and extending in a direction from the first membrane sheet toward the lower insulation, wherein the securing base support is spot-welded to the first membrane sheet, wherein the second membrane sheet is line-welded to the first membrane sheet, wherein the thermal protection member is interposed between the first membrane sheet and the upper insulation to protect from damage to the upper insulation by flame or heat from welding of the first membrane sheet.

8. A cargo hold comprising the anchor strip-free insulation structure according to claim 1.

9. A liquefied natural gas (LNG) carrier comprising the cargo hold according to claim 8.

10. The anchor strip-free insulation structure according to claim 1, wherein the thermal protection member comprises a strip which comprises an aluminum foil layer and a glass cloth layer disposed over the aluminum foil layer, wherein the securing base support comprises an metal insert.

11. The anchor strip-free insulation structure according to claim 7, wherein the thermal protection member comprises a strip which comprises an aluminum foil layer and a glass cloth layer disposed over the aluminum foil layer, wherein the securing base support comprises an metal insert.

* * * * *